US008172039B2

(12) United States Patent
Park et al.

(10) Patent No.: US 8,172,039 B2
(45) Date of Patent: May 8, 2012

(54) MUFFLER FOR VEHICLE

(75) Inventors: Kichul Park, Suwon-si (KR); Deagil Hwang, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 12/941,798

(22) Filed: Nov. 8, 2010

(65) Prior Publication Data

US 2012/0055736 A1 Mar. 8, 2012

(30) Foreign Application Priority Data

Sep. 7, 2010 (KR) ..... 10-2010-0087435

(51) Int. Cl.

| | |
|---|---|
| ***F01N 1/24*** | (2006.01) |
| ***F01N 1/10*** | (2006.01) |
| ***F01N 1/08*** | (2006.01) |
| ***F01N 1/04*** | (2006.01) |
| *F01N 1/00* | (2006.01) |
| *F01N 1/02* | (2006.01) |

(52) U.S. Cl. ..... 181/256; 181/252; 181/272; 181/257; 181/239; 181/275

(58) Field of Classification Search ..... 181/256, 181/252, 272, 275, 281, 268, 269, 257, 258, 181/251, 239, 238

See application file for complete search history.

(56) References Cited

U.S. PATENT DOCUMENTS

| | | | | |
|---|---|---|---|---|
| 2,553,306 | A * | 5/1951 | Dietrich | 96/387 |
| 4,290,501 | A * | 9/1981 | Tanaka | 181/228 |
| 4,381,832 | A * | 5/1983 | Rauch | 181/266 |
| 4,589,517 | A * | 5/1986 | Fukuda | 181/265 |
| 4,848,513 | A * | 7/1989 | Csaszar | 181/265 |
| 4,913,260 | A * | 4/1990 | Fallon | 181/254 |
| 4,971,166 | A * | 11/1990 | Hase | 181/254 |
| 5,614,699 | A * | 3/1997 | Yashiro et al. | 181/254 |
| 5,726,397 | A * | 3/1998 | Mukai et al. | 181/232 |
| 5,739,483 | A * | 4/1998 | Yashiro et al. | 181/254 |
| 6,176,347 | B1 * | 1/2001 | Chae et al. | 181/254 |
| 6,394,225 | B1 * | 5/2002 | Yasuda | 181/256 |
| 6,427,802 | B1 * | 8/2002 | Yokoi et al. | 181/282 |
| 6,619,426 | B2 * | 9/2003 | Minami et al. | 181/251 |
| 7,062,908 | B2 * | 6/2006 | Yamamoto | 60/299 |
| 7,694,778 | B2 | 4/2010 | Toyoshima et al. | |
| 7,789,195 | B2 | 9/2010 | Mabuchi et al. | |
| 2004/0238272 | A1 * | 12/2004 | Wan et al. | 181/251 |
| 2006/0150620 | A1 | 7/2006 | Nagai | |

(Continued)

FOREIGN PATENT DOCUMENTS

| | | | |
|---|---|---|---|
| JP | 55069717 | A * | 5/1980 |

(Continued)

*Primary Examiner* — Edgardo San Martin
(74) *Attorney, Agent, or Firm* — Morgan, Lewis & Bockius LLP

(57) ABSTRACT

A muffler for a vehicle may include a plurality of baffles to form a plurality of chambers, an exhaust gas inflow pipe having an outlet connected to one of the chambers inside the muffler housing through the baffles, an intermediate pipe disposed in parallel with the exhaust gas inflow pipe in the muffler housing through the baffles to fluid connect at least two chambers and a plurality of exhaust gas outflow pipes having an inlet positioned with an outlet of the intermediate pipe in any one chamber divided by the baffles and an outlet protruding outward through the muffler housing, without passing through the baffles, such that the exhaust gas passing through the intermediated pipe may be discharged outside the muffler housing.

10 Claims, 2 Drawing Sheets

U.S. PATENT DOCUMENTS

| | | | | |
|---|---|---|---|---|
| 2007/0125594 | A1* | 6/2007 | Hill | 181/256 |
| 2009/0229911 | A1* | 9/2009 | Scotti et al. | 181/241 |

FOREIGN PATENT DOCUMENTS

| | | | | |
|---|---|---|---|---|
| JP | 02238115 | A | * | 9/1990 |
| JP | 5187217 | A | * | 7/1993 |
| JP | 2006-250055 | A | | 9/2006 |
| JP | 2009-74529 | A | | 4/2009 |
| JP | 2009-215941 | A | | 9/2009 |
| KR | 10-2008-0028140 | A | | 3/2008 |
| KR | 10-2010-0005982 | A | | 1/2010 |

* cited by examiner

MUFFLER FOR VEHICLE

CROSS-REFERENCE TO RELATED APPLICATIONS

The present application claims priority to Korean Patent Application Number 10-2010-0087435 filed Sep. 7, 2010, the entire contents of which application is incorporated herein for all purposes by this reference.

BACKGROUND OF THE INVENTION

1. Field of the Invention

The present invention relates to a muffler for a vehicle, and more particularly, to a muffler for a vehicle having a dual exhaust gas outflow pipe with the outlet under the center of the rear bumper.

2. Description of Related Art

Mufflers for vehicles in the related art has a plurality of chambers that are formed by disposing one or more baffles in a closed muffler housing having a predetermined volume, an exhaust gas inflow pipe through which an exhaust gas flows inside the muffler housing, and an exhaust gas outflow pipe through which an exhaust gas flows outside the muffler housing, in which the exhaust gas that has flowed inside the muffler housing through the exhaust gas inflow pipe, flows through an exhaust channel formed in the muffler housing, and consequently flows outside the muffler housing through the exhaust gas outflow pipe, with the pressure and sound reduced.

However, since the mufflers commonly used in the related art have a single exhaust gas outflow pipe, it is difficult for small vehicles to give dynamic and powerful image to consumers. Further, since the outlet of the exhaust gas outflow pipe is positioned at the right end or the left end of the rear bumper, productivity is difficult to appeal to young consumers following polished image.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a muffler for a vehicle that can impress consumers with dynamic, powerful, and polished image by making the exhaust gas outflow pipe in a dual type and disposing the outlet of the exhaust gas outflow pipe at the lower center of the rear bumper, thereby contributing to improving productivity of vehicles.

In an aspect of the present invention, the muffler for a vehicle may include a plurality of baffles fixed in a predetermined distance therebetween in the longitudinal direction of a muffler housing in the muffler housing to form a plurality of chambers between the baffles, an exhaust gas inflow pipe having an inlet connected with the muffler through the front of the muffler housing and an outlet connected to one of the chambers inside the muffler housing through the baffles, an intermediate pipe disposed in parallel with the exhaust gas inflow pipe in the muffler housing through the baffles to fluid connect at least two chambers such that an exhaust gas passing through the exhaust gas inflow pipe flows therethrough, and a plurality of exhaust gas outflow pipes having an inlet positioned with an outlet of the intermediate pipe in any one chamber divided by the baffles and an outlet protruding outward through the muffler housing, without passing through the baffles, such that the exhaust gas passing through the intermediated pipe may be discharged outside the muffler housing.

The chamber in which the outlet of the exhaust gas inflow pipe may be disposed, may be different from the chamber in which an inlet of the intermediate pipe may be disposed.

A plurality of holes may be formed at a portion of the exhaust gas inflow pipe in a chamber to which the output of the exhaust gas inflow pipe may be not fluidly connected.

A chamber in which the inlet and outlet of the exhaust gas inflow pipe and the inlet and outlet of the intermediate pipe may be not received, may be filled with a sound-absorbing material for improve heat insulating performance, wherein the sound-absorbing material may be made of glass wool.

Baffles that form the chamber having the sound-absorbing material therein, may have a plurality of connection channels therein to reduce exhaust noise and flow-induced noise.

In another aspect of the present invention, the muffler for a vehicle may include first, second, and third baffles that may be fixed at a predetermined distance in the longitudinal direction of the muffler housing in the muffler housing, an internal space of the muffler housing may be divided into first, second, third, and fourth chambers by the first, second, and third baffles, an exhaust gas inflow pipe may have an inlet protruding outside through the front of the muffler housing and an outlet positioned in the fourth chamber through the first, second, and third baffles, an intermediate pipe may have an inlet positioned in the third chamber through the first and second baffles and an outlet positioned in the first chamber, exhaust gas outflow pipes may have an inlet positioned in the first chamber and an output protruding outside through a side of the muffler housing, and a plurality of holes may be formed at the section from the exhaust gas inflow pipe to the third chamber.

The exhaust gas outflow pipes make a dual pipe composed of first and second exhaust gas outflow pipes.

The outlets of the first and second exhaust gas outflow pipes may be exposed to the outside, at a lower center of a rear bumper.

The second chamber may be filled with a sound-absorbing material for improve heat insulating performance, wherein the sound-absorbing material may be made of glass wool, wherein the first baffle may have a plurality of connection channels connecting the first and second chambers to reduce exhaust noise and flow-induced noise, and wherein the second baffle may have a plurality of connection channels connecting the second and third chambers to reduce exhaust noise and flow-induced noise.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
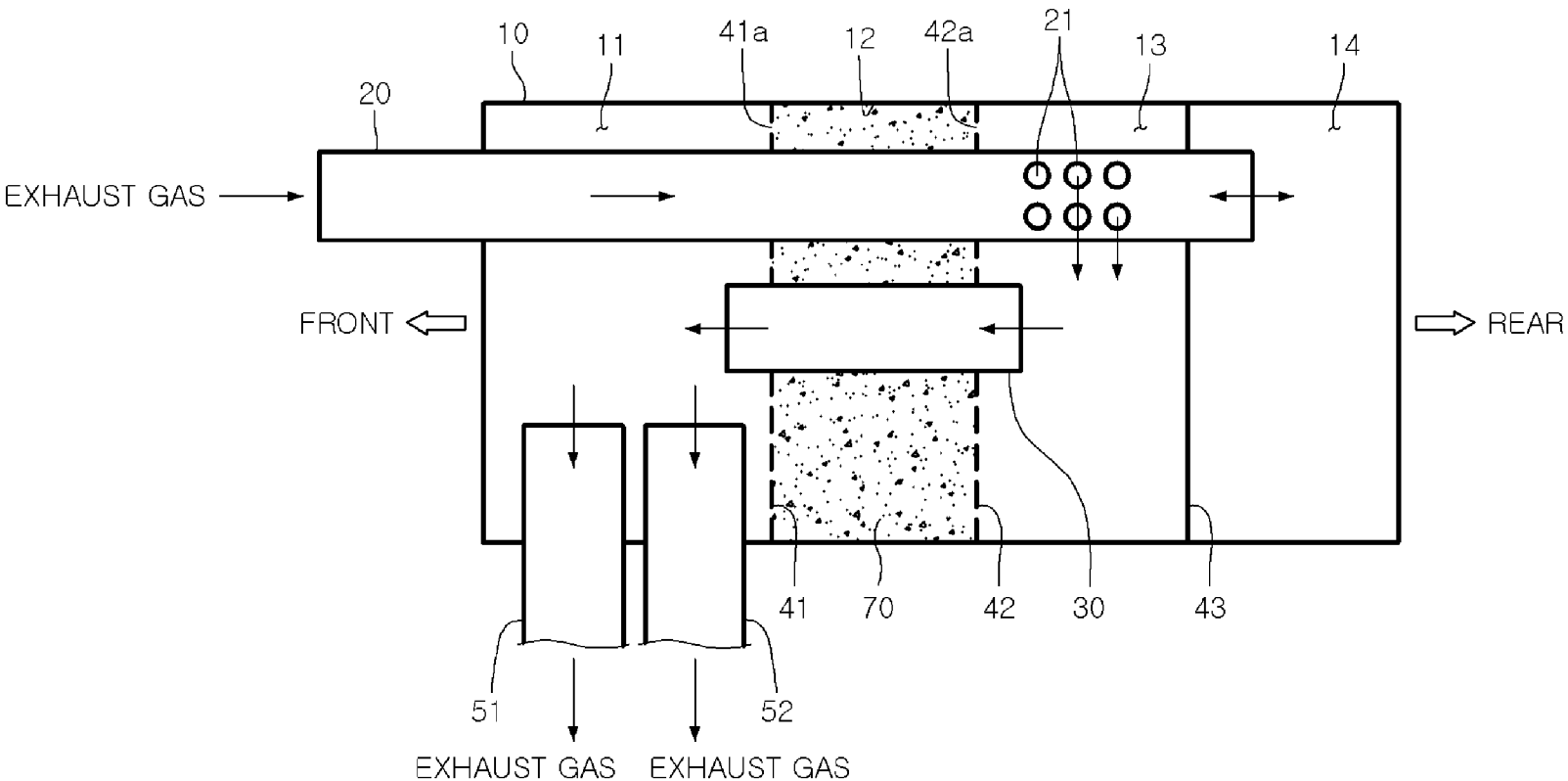
FIG. 1 is a cross-sectional view of a muffler for a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, exemplary embodiment of the present invention will be described in detail with reference to the accompanying drawings.

Figure 2:
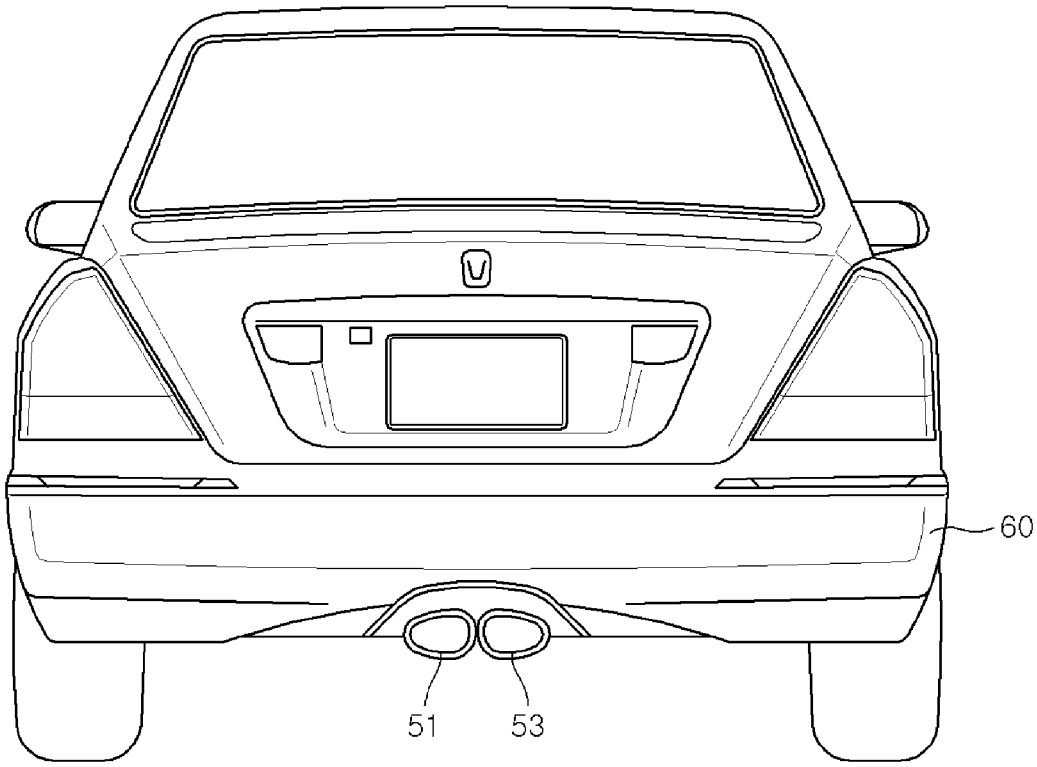
FIG. 2 is a front view of the rear side of a vehicle equipped with a muffler for a vehicle according to an exemplary embodiment of the present invention.

A muffler for a vehicle according to an exemplary embodiment of the present invention, as shown in FIGS. 1 and 2, includes: a plurality of baffles fixed at a predetermined distance in the longitudinal direction of a muffler housing 10 in muffler housing 10, which has a predetermined closed volume, an exhaust gas inflow pipe 20 having an inlet connected with the muffler through the front of muffler housing 10 and an outlet fixed inside muffler housing 10 through the baffle, an intermediate pipe 30 fixed in parallel with exhaust gas inflow pipe 20 in muffler housing 10 through the baffle such that an exhaust gas passing through exhaust gas inflow pipe 20 can flow, and a plurality of exhaust gas outflow pipes having an inlet positioned with the outlet of intermediate pipe 30 in any one chamber divided by the baffle and an outlet protruding outward through the side of muffler housing 10, without passing through the baffle, such that the exhaust gas passing through intermediated pipe 30 can be discharged outside muffler housing 10.

That is, first, second, and third baffles 41, 42, and 43 are fixed at a predetermined distance in the longitudinal direction of muffler housing 10 in muffler housing 10, and accordingly, the internal space of muffler housing 10 is divided into first, second, third, and fourth chambers 11, 12, 13, and 14 by first, second, and third baffles 41, 42, and 43.

Further, exhaust gas inflow pipe 20 has an inlet protruding outside through the front of muffler housing 10 and an outlet positioned in fourth chamber 14 through first, second, and third baffles 41, 42, and 43.

Further, intermediate pipe 30 has an inlet positioned in third chamber 13 through first and second baffles 41 and 42 and an outlet positioned in first chamber 11.

Further, the exhaust gas outflow pipes have an inlet positioned in first chamber 11 and an outlet protruding outside through the side of muffler housing 10.

In this structure, exhaust gas flowing into muffler housing 10 through exhaust gas inflow pipe 20 flows into the inlet of intermediate pipe 30 from third chamber 13, and a plurality of holes 21 is formed at the section from exhaust gas inflow pipe 20 to third chamber 13 in order to achieve the structure.

Meanwhile, according to the exemplary embodiment of the present invention, the exhaust gas outflow pipes make a dual pipe composed of first and second exhaust gas outflow pipes 51 and 52, and the outlets of first and second exhaust gas outflow pipes 51 and 52 are exposed to the outside at the lower center of a rear bumper 60.

As described above, since the exhaust gas outflow pipes make a dual pipe composed of first and second exhaust gas outflow pipes 51 and 52 and the outlet is positioned at the lower center of rear bumper 60 and exposed to the outside, a dynamic, powerful, and polished image can appeal to consumers, such that it is possible to considerably improve productivity of vehicles.

In particular, for small vehicles, productivity can impressively appeal to young consumers.

Therefore, some of the exhaust gas flowing in muffler housing 10 through exhaust gas inflow pipe 20 is discharged to fourth chamber 14 through the outlet of exhaust gas inflow pipe 20, in which the movement space of the exhaust gas significantly increases from exhaust gas inflow pipe 20 to fourth chamber 14, such that the exhaust gas decreases in pressure and speed, thereby considerably reducing exhaust noise and flow-induced noise.

Further, fourth chamber 14 functions as a Helmholtz resonator, such that it is possible to significantly reduce exhaust noise and booming noise at a predetermined frequency.

Further, the exhaust gas in fourth chamber 14 flows into exhaust gas inflow pipe 20 again through the outlet of exhaust gas inflow pipe 20 and is discharged to third chamber 13 through holes 21, together with the other exhaust gas.

In this process, the movement space of the exhaust gas also largely increases from exhaust gas inflow pipe 20 to third chamber 13, such that the exhaust gas decreases in pressure and speed, thereby significantly reducing exhaust noise and flow-induced noise.

Further, the exhaust gas in third chamber 13 is discharged to first chamber 11 through intermediate pipe 30, in which the movement space of the exhaust gas also largely increases from intermediate pipe 30 to first chamber 11, such that the exhaust gas decreases in pressure and speed, thereby considerably reducing exhaust noise and flow-induced noise.

Further, the exhaust gas in first chamber 11 is finally discharged outside muffler housing 10 through first and second exhaust gas outflow pipes 51 and 52 making the dual pipe, in which the exhaust gas outflow pipe is formed of the dual pipe composed of first and second exhaust gas outflow pipes 51 and 52, such that resistance in flow of the exhaust gas is largely reduced, which considerably contributes to reducing exhaust noise and flow-induced noise and improving the output.

Meanwhile, in the muffler for a vehicle according to the exemplary embodiment of the present invention, second chamber 12 is filled with a sound-absorbing material 70 to improve heat insulating performance and sound-absorbing material 70 is made of glass wool.

Since sound-absorbing material 70 is provided, it is possible to protect the muffler from thermal damage of the vehicle and accordingly durability of the muffler is considerably improved.

Further, the muffler for a vehicle according to the exemplary embodiment of the present invention has a structure having a plurality of connection channels 41*a* connecting first and second chambers 11 and 12 to first baffle 41.

Accordingly, some of the exhaust gas in first chamber 11 is sucked into sound-absorbing material 70 of second chamber 12 through connection channels 41*a*, and as a result, it is possible to considerably reduce high-frequency exhaust noise.

Further, the muffler for a vehicle according to the exemplary embodiment of the present invention has a structure having a plurality of connection channels 42*a* connecting second and third chambers 12 and 13 to second baffle 42.

Accordingly, some of the exhaust gas in third chamber 13 is sucked into sound-absorbing material 70 of second chamber 12 through connection channels 42*a*, and as a result, it is possible to considerably reduce high-frequency exhaust noise.

Meanwhile, the installation space is small in small vehicles, such that it is required to reduce the size of the muffler, however, in this case, the exhaust noise, flow-induced noise, and booming noise of the exhaust gas may not be sufficiently reduced.

However, in the muffler for a vehicle according to the exemplary embodiment of the present invention, the exhaust noise, flow-induced noise, and booming noise can be sufficiently reduced through connection channels 41*a* and 42*a* of first and second baffles 41 and 42, holes 21 of exhaust gas inflow pipe 20, sound-absorbing material 70 filled in second chamber 12, and first and second exhaust outflow pipes 51 and 52 making the dual pipe, such that it is possible to reduce the size of the muffler and the muffler can be used in small vehicles.

Further, in the muffler for a vehicle according to the exemplary embodiment of the present invention, heat insulating performance is considerably improved by sound-absorbing material 70 filled in second chamber 12, such that the muffler can be effectively protected against thermal damage of the vehicle and durability is largely improved.

Further, in the muffler for a vehicle according to the exemplary embodiment of the present invention, since the exhaust gas outflow pipes make a dual pipe composed of first and second exhaust gas outflow pipes 51 and 52 and the outlet is positioned at the lower center of rear bumper 60 and exposed to the outside, a dynamic, powerful, and polished image can appeal to consumers, such that it is possible to considerably improve productivity of vehicles.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A muffler for a vehicle, comprising:

a plurality of baffles fixed in a predetermined distance therebetween in the longitudinal direction of a muffler housing in the muffler housing to form a plurality of chambers between the baffles;

an exhaust gas inflow pipe having an inlet connected with the muffler through the front of the muffler housing and an outlet connected to one of the chambers inside the muffler housing through the baffles;

an intermediate pipe disposed in parallel with the exhaust gas inflow pipe in the muffler housing through the baffles to fluid connect at least two chambers such that an exhaust gas passing through the exhaust gas inflow pipe flows therethrough; and a plurality of exhaust gas outflow pipes having an inlet positioned with an outlet of the intermediate pipe in any one chamber divided by the baffles and an outlet protruding outward through the muffler housing, without passing through the baffles, such that the exhaust gas passing through the intermediated pipe is discharged outside the muffler housing;

wherein a plurality of holes is formed at a portion of the exhaust gas inflow pipe in a chamber to which the output of the exhaust gas inflow pipe is not fluidly connected;

wherein first, second, and third baffles are fixed at a predetermined distance in the longitudinal direction of the muffler housing in the muffler housing;

an internal space of the muffler housing is divided into first, second, third, and fourth chambers by the first, second, and third baffles;

the exhaust gas inflow pipe has the inlet protruding outside through the front of the muffler housing and the outlet positioned in the fourth chamber through the first, second, and third baffles;

the intermediate pipe has an inlet positioned in the third chamber through the first and second baffles and the outlet positioned in the first chamber;

the exhaust gas outflow pipes have the inlet positioned in the first chamber and an output protruding outside through a side of the muffler housing;

the plurality of holes is formed at the section from the exhaust gas inflow pipe to the third chamber; and the outlets of the first and second exhaust gas outflow pipes are exposed to the outside, at a lower center of a rear bumper.

2. The muffler for a vehicle as defined in claim 1, wherein the chamber in which the outlet of the exhaust gas inflow pipe is disposed, is different from the chamber in which an inlet of the intermediate pipe is disposed.

3. The muffler for a vehicle as defined in claim 2, wherein a chamber in which the inlet and outlet of the exhaust gas inflow pipe and the inlet and outlet of the intermediate pipe are not received, is filled with a sound-absorbing material for improve heat insulating performance.

4. The muffler for a vehicle as defined in claim 3, wherein the sound-absorbing material is made of glass wool.

5. The muffler for a vehicle as defined in claim 3, wherein baffles that form the chamber having the sound-absorbing material therein, have a plurality of connection channels therein to reduce exhaust noise and flow-induced noise.

6. The muffler for a vehicle as defined in claim 1, wherein the exhaust gas outflow pipes make a dual pipe composed of first and second exhaust gas outflow pipes.

7. The muffler for a vehicle as defined in claim 1, wherein the second chamber is filled with a sound-absorbing material for improve heat insulating performance.

8. The muffler for a vehicle as defined in claim 7, wherein the sound-absorbing material is made of glass wool.

9. The muffler for a vehicle as defined in claim 7, wherein the first baffle has a plurality of connection channels connecting the first and second chambers to reduce exhaust noise and flow-induced noise.

10. The muffler for a vehicle as defined in claim 7, wherein the second baffle has a plurality of connection channels connecting the second and third chambers to reduce exhaust noise and flow-induced noise.

* * * * *